US005676369A

United States Patent [19]

DeWeese

[11] Patent Number: 5,676,369

[45] Date of Patent: Oct. 14, 1997

[54] METHOD OF PLAYING A BREWING GAME

[76] Inventor: Mark Keathon DeWeese, 1425 Northview Dr., Angleton, Tex. 77515

[21] Appl. No.: 754,185

[22] Filed: Nov. 7, 1996

Related U.S. Application Data

[63] Continuation-in-part of Ser. No. 535,609, Sep. 12, 1995, abandoned.

[51] Int. Cl.[6] ..... A63F 3/00

[52] U.S. Cl. ..... 273/249; 273/276

[58] Field of Search ..... 273/242, 243, 273/248, 249, 276

[56] References Cited

U.S. PATENT DOCUMENTS

| | | | |
|---|---|---|---|
| 3,468,540 | 9/1969 | Mulligan | 273/276 X |
| 4,136,881 | 1/1979 | Anspach . | |
| 4,484,748 | 11/1984 | Becze . | |
| 4,529,205 | 7/1985 | Bowker . | |
| 4,856,788 | 8/1989 | Fischel . | |
| 4,907,808 | 3/1990 | Turner . | |
| 4,948,146 | 8/1990 | Snyder et al. | 273/276 X |
| 4,950,912 | 8/1990 | Goldfarb et al. | 273/276 X |
| 4,962,934 | 10/1990 | Taylor . | |
| 5,007,650 | 4/1991 | Reed . | |
| 5,080,369 | 1/1992 | Mongno | 273/276 X |
| 5,121,928 | 6/1992 | Salgrno . | |
| 5,190,292 | 3/1993 | Perry . | |
| 5,318,304 | 6/1994 | Reppas . | |

*Primary Examiner*—William E. Stoll
*Attorney, Agent, or Firm*—Mark B. Jones

[57] ABSTRACT

A method of playing a board game related to brewing procedures and the science of brewing. The game includes a board having an endless path divided into a plurality of continuous spaces including a starting space and spaces with indicia upon them corresponding to hops, barley, yeast, brewing science and speciality beer styles. At least two players start by moving their playing pieces along a path according to a roll of the die. Upon landing on a space, a player must pick a card corresponding to that space. The card may require the player to correctly answer a question or may award or hinder his progress in the game. If the card requires an answer, which is correctly answered, the player is allowed to roll again and continue around the board. Upon passing the starting point the player is awarded a piece of brewery equipment. Players continue collecting brewing equipment while moving around the board. Play is terminated when a player receives all of the equipment necessary to operate a brewery.

1 Claim, 4 Drawing Sheets

20

21

25

22

24

23

METHOD OF PLAYING A BREWING GAME

This is a continuation in part of application Ser. No. 08/535,609, filed Sep. 12, 1995, now abandoned.

BACKGROUND OF THE INVENTION

There are a large number of board games available in the marketplace. Many board games require a player to travel around a peripheral path or track. The path or track may be continuous or have branches that interconnect at various locations on the board. The games vary with respect to their manner of play and requirements for winning. Some of these games are designed to provide entertainment for those who participate in the games. Other games are designed to provide entertainment as well as educate the players about a particular subject. Games of this type are won by the player who is able to master the subject matter that the game is intended to teach.

The resurgence in home brewing and micro-brewing has created a renewed interest in the art of brewing. The art of brewing is steeped in history and myth. The brewing of beer involves use of grain, hops, yeast and water with the differences in product depending on the type of raw materials used and the process variables used to convert them. Over the centuries, various types of equipment have become standard in the brewing process. Typically equipment such as a mill, mash tun, brew kettle, fermenter and a conditioning tank are used. The mill is used to crush the malted barley into a meal call "grist". The grist may be temporarily stored in a grist hopper. The next step is to transfer the grist to a mash tun. This device is also known in the trade as a lauter tun. In the tun the grist is mixed with hot water to form a "mash". The enzymes in the heated mash convert the starches in the grist into sugars. After the starch has been converted to sugar, the mash is washed with water to remove the sugars. The resulting liquid is called "wort" which is transferred to the brew kettle. The wort is boiled in this kettle and hops are added to give bittering, flavor and aroma characteristics to the beer. The boiling wort is cooled by running it through a heat exchanger prior to transferring it to a fermenter. Yeast is added to the cooled wort in a process known in the trade as "pitching". The liquid is left in the fermenter for sufficient time to allow the yeast to convert the sugars to alcohol and carbon dioxide. The fermented wort is referred to as beer. The beer is transferred to a conditioning tank where it is allowed to age and develop its matured carbonation. Prior to serving the beer may be filtered.

A game which takes the myth out of the art of brewing while teaching about brewing would be useful and entertaining to those who are interested in the subject.

OBJECTS OF THE INVENTION

It is the general object of the present invention to provide a novel educational game that is directed to the subject of brewing and beer related topics.

It is further object of the invention to increase the knowledge of hops, barley and yeast used in the brewing of beer. The game is educational in that the players may test and increase their knowledge of the art of brewing which may be applied to the actual brewing of beer.

Additional objects, advantages and features of the present invention will become apparent from the following description and appended claims, taken in conjunction with the accompanying drawings.

SUMMARY OF THE INVENTION

The first aspect is a method of playing a board game based on the brewing of beer including: a game board having an endless track thereon, said endless track formed by a continuous series of spaces over which a player advances during play of the game in which at least two players take turns as described below, at least one of said spaces being a starting space and said spaces other than said starting space having indicia thereon corresponding to a respective area of brewing; a plurality of differently identified playing pieces, each assigned to a different player; a first set of cards having indicia thereon corresponding to said spaces, the cards containing information in the form of questions and answers relating to beer and brewing; a second set of cards containing penalties or rewards of chance; a chance indicator means for determining advancement of said playing pieces around the board from space to space; and a plurality of tokens representing the equipment required for building a brewery, said method comprising the steps of at least two players in turn advancing a playing piece along a predetermined number of said spaces, as determined by said chance indicator means; identifying the set of cards corresponding to the space upon which said playing piece lands; picking a card from the stack corresponding to said set of cards; asking the question from said card or following the directions on the card; permitting the player to correctly answer the question if required by the card and allowing said player to repeat steps (a)–(e); repeating steps (a)–(e) for another player if the first mentioned player incorrectly answers the question or loses a turn as a result of the directions on the card; supplying a marker corresponding to a piece of equipment needed for building a brewery when the playing piece passes or lands on the starting space; and terminating play when at least one player receives a marker for each piece of equipment required to build a brewery or at least one player decides the game is over.

DETAILED DESCRIPTION

The present invention relates to a board game and more particularly to a board game that is designed to enhance a player's knowledge of brewing procedures and science.

The present invention includes a game board having an endless track divided into a series of contiguous spaces, at least one of the spaces being a starting space and the spaces other than the starting space having indicia thereon corresponding to a respective area of the art of brewing; a plurality of differently identified playing pieces, each assigned to a different player; a plurality of stacks of cards with each stack of cards having indicia corresponding to specific spaces, some cards having a question and answer on one side of the card, other cards having a bonus or penalty on one side of the card; a chance indicator means for determining advancement of the playing pieces around the board from space to space, wherein a player must correctly answer the question printed on the card which corresponds to the category of the space to which the player is advanced or acting on the bonus or penalty listed on the card, repeating the step of advancement if the player correctly answers the question or if allowed to proceed by the bonus or penalty card; repeating the steps of advancement for another player if the first mentioned player fails to correctly answer the question or loses their turn due to a penalty card; a plurality of markers representing the equipment needed to build a brewery; and each player receiving a marker corresponding to equipment for building a brewery each time the player passes the starting space, wherein play is terminated when a player receives all the markers required to build a brewery.

Figure 1:
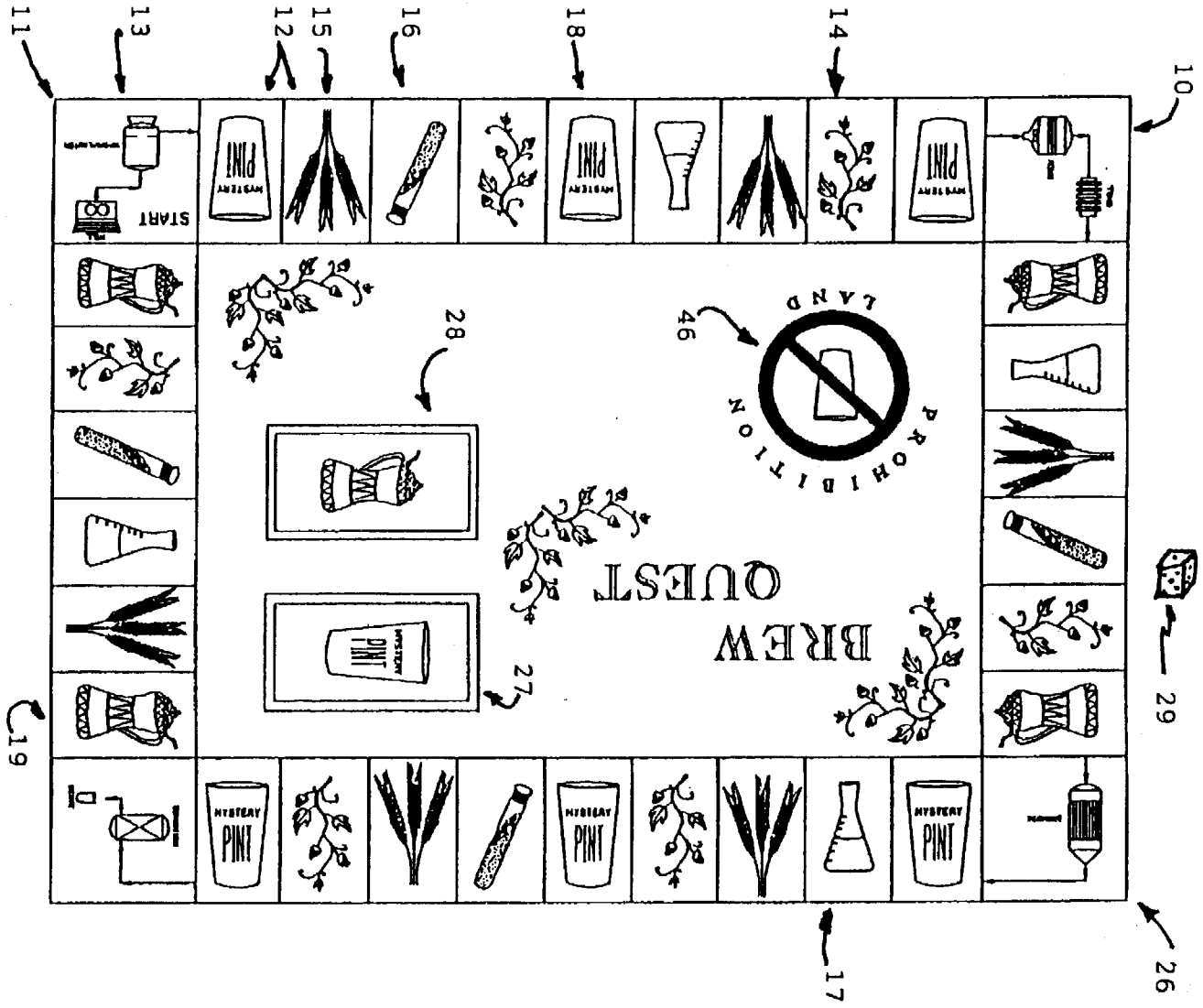
FIG. 1 is a plan view of the game board.

The game is played on the board depicted in FIG. 1. The game board (10) has a peripheral track (11) comprised of a plurality of spaces (12) forming a continuous track. The track includes thirty-four spaces: one "start" space (13), six "hop" spaces (14), six "barley" spaces (15), four "yeast" spaces (16), four "brewing science" spaces (17), six "mystery pint" spaces (18), four "specialty spaces (19) and three corner spaces (26). It will be appreciated that other arrangements of the playing spaces are feasible as well.

Figure 2:
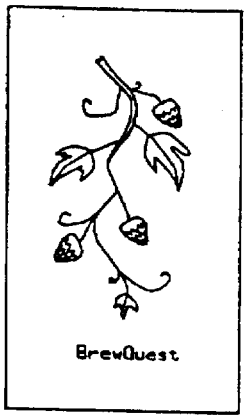
FIG. 2 is a perspective view of an example of each playing card.
Figure 2:
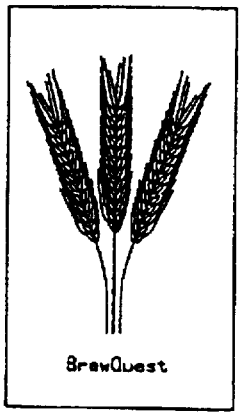
Figure 2:
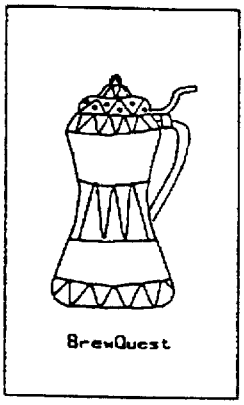
Figure 2:
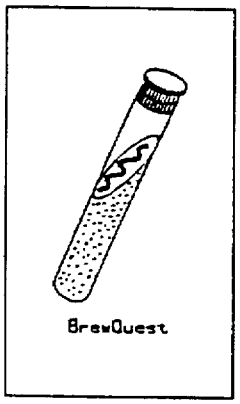
Figure 2:
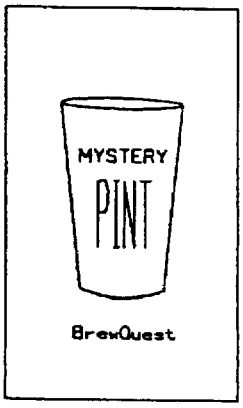
Figure 2:
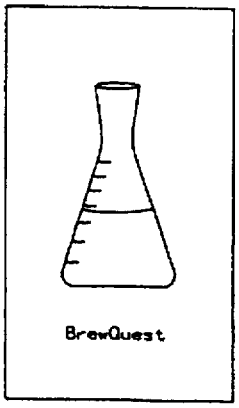

Each of the "hop" (14), "barley" (15), "yeast" (16), and "brewing science" (17) spaces correspond to a stack of "hop" (20), "barley" (21), "yeast" (22), and "brewing science" (23) cards. FIG. 2 shows the indicia on the spaces which match the indicia on the cards corresponding to the spaces. These cards may be kept in a container which may or may not be incorporated into the board. One side of each card contains a question and answer pertaining to a subject that corresponds to the space that the player landed on. Table 1 lists some examples of the questions and answers that can be provided for each type of card.

TABLE 1

| TYPE OF CARD | QUESTION AND ANSWER |
|---|---|
| Hop | Q: What distinctive hop variety is used in the original pilsner beers from Czechoslovakia?<br>A: Saaz |
| Barley | Q: In Germany and North Africa, these are known by the local name "Prophet's barley"?<br>A: "Huskless" or "naked barleys" |
| Yeast | Q: Yeast used in beer production belong to what genus?<br>A: Saccharomyces |
| Brewing Science | Q: The addition of gypsum to brewing water is known as what?<br>A: Burtonisation |

The degree of knowledge required by the players may be adjusted by use of cards developed for novice, intermediate and advanced players. Sets of cards developed for each skill level may be provided with the game or added at a later date. It is foreseeable, as the popularity of the game grows that a demand for more cards will occur.

In addition to the playing spaces, spaces are also provided on the playing surface of the board (10) which designates spaces on which various decks of cards may be placed. At least two decks of cards are located on the playing board; mystery pint (24) and specialty (25) cards. The indicia denoting the cards and the their spaces are shown in FIG. 2. The locations for these cards are denoted by a space bearing a glass labeled "mystery pint" (27) for mystery pint cards and a space bearing a stein for specialty cards (28). The "mystery pint" card contains either a penalty or reward for the player that draws the card in the course of play. The "specialty" card has a question and answer on one side of the card dealing with the area of specialty beers.

Figure 3:
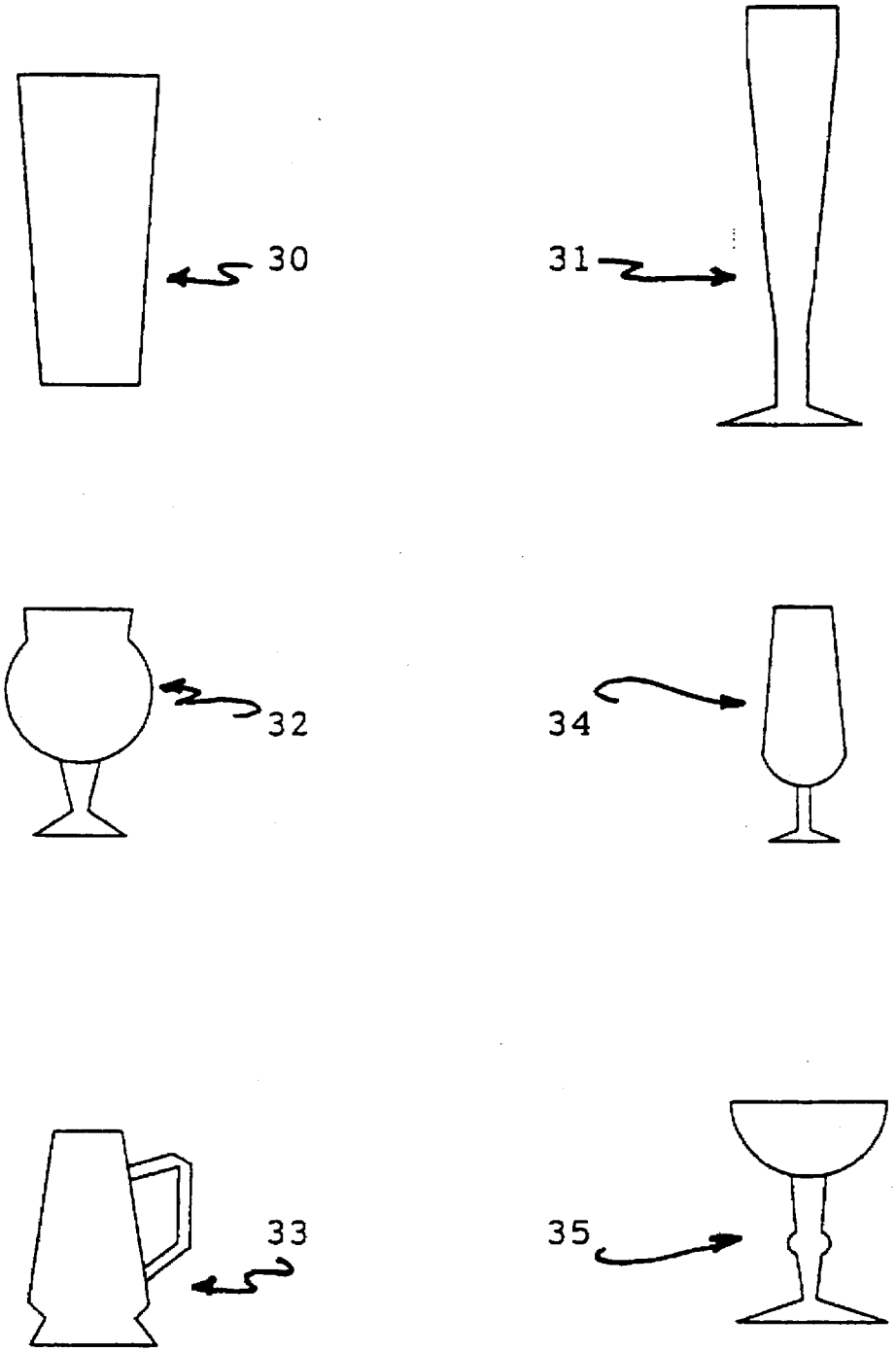
FIG. 3 is a side view of the playing pieces.
Figure 4:
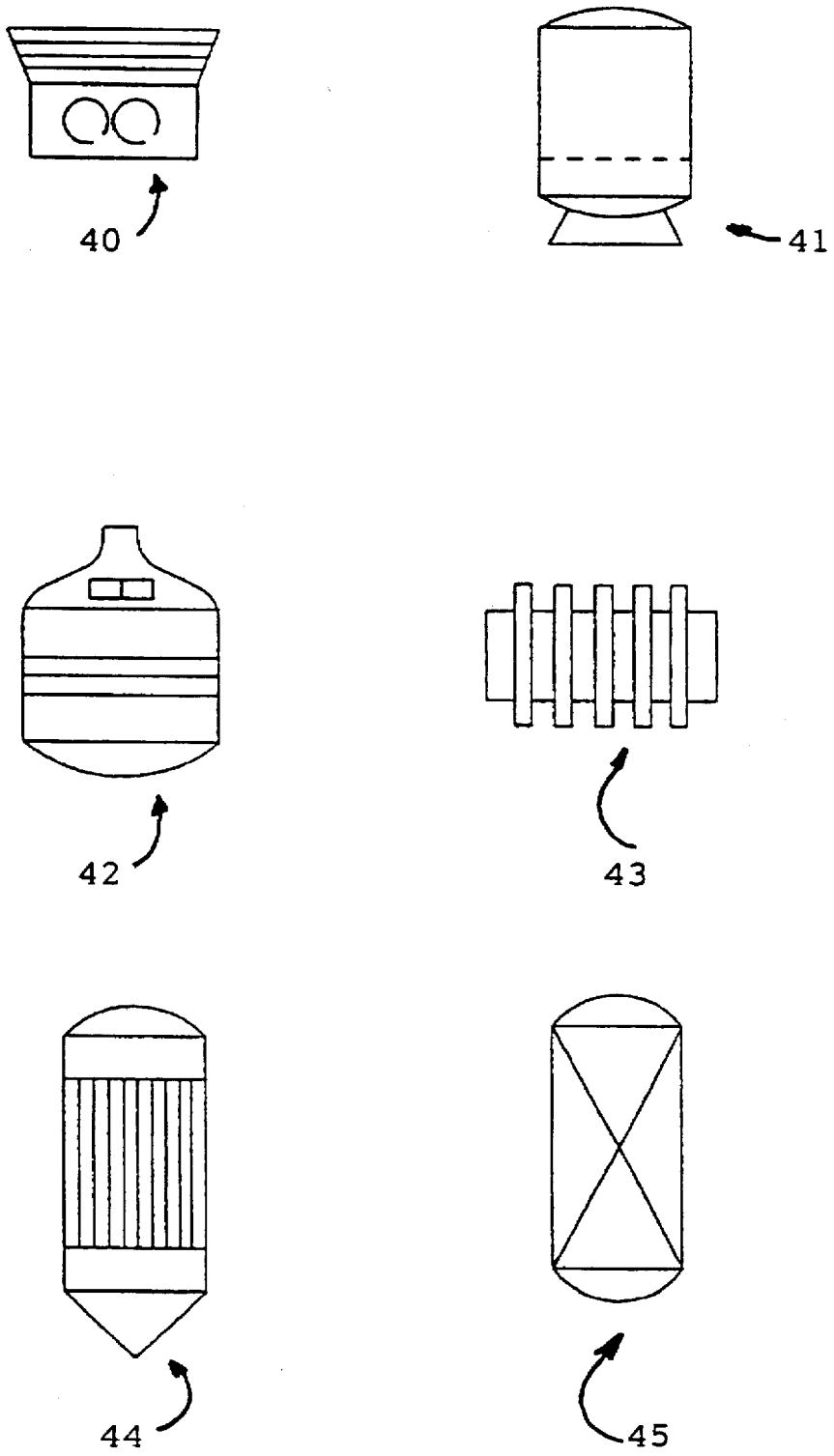
FIG. 4 is a side view of the brewery equipment pieces.

The playing apparatus for the game includes the playing cards previously discussed, playing pieces and brewery equipment pieces, and a die (29) for indicating the number of spaces a player should move during a turn at play. The playing pieces may consist of any object, however, it is preferable that they consist of pieces shaped like devices used to hold beer. FIG. 3 shows examples of beer glasses such as a tumbler (30), weisen glass (31), tulip glass (32), tankard (33), pilsner glass (34), and a chalice (35). It is readily apparent that other objects related to beer and beer brewing may also be used as playing pieces. The brewery equipment pieces, FIG. 4, typically would include pieces shaped like a grain mill (40), mash/lauter tun (41), brew kettle (42), plate exchanger (43), fermentation tank (44), and a conditioning/serving tank (45). The chance indicator means may consist of any object that can be used to determine the advancement of a player. Any method previously used in games may be used. Various items used in the art include, but are not limited to, electronic means, spin wheels, a die or dice and the like. The most preferred means is use of a die. For simplicity, a die will be used in explaining the method of playing the game.

Hop cards (20) are used when a player lands on a board space decorated with a hop vine. The hop cards ask questions specific to hops in relation to beer and brewing. The questions may deal with hop variety, area of origin, purpose in particular beer styles. Barley cards (21) are used when a player lands on a board space decorated with barley stalks. The barley cards ask questions specific to barley in relation to beer and brewing. The questions may deal with variety, country of origin, malting and kilning procedures, use in particular styles of beer. Yeast cards (22) are used when a player lands on a board space illustrated with a test tube referred to as an agar slant. Yeast cards ask questions specific to yeast in relation to beer production. The questions may deal with particular strains, wild yeasts, yeast handling, starters, pitching procedures, etc. Brewing science cards (23) are used when a player lands on a board space marked with a Pyrex® flask or Erlenmeyer flask. Brewing science cards ask questions specific to beer brewing procedures and chemical processes that take place during mashing, sparging, boiling, fermentation, and conditioning. The questions selected for use in the game are dependent only on the skill level of the players. It's readily apparent that any area of brewing may be adapted to this question and answer format. Mystery pint cards (24) can award or take away brewery equipment pieces, send the player to prohibition land, (46) advance the player on the game board (10), grant a ticket out of prohibition land (46), or cause a player to have to skip a turn. Mystery pint cards incorporate a "chance" element into the game. They player must take whatever action the card calls out such as; "fermenter exploded a total loss". Specialty cards ask questions about specialty beer styles such as lambics, trappist ales, wit beers, rauchbeirs, maiboks, doppelboks. Specialty cards (25) allow a player to move ahead a certain number of spaces on the board if the question is answered correctly and then they wait until their next turn. The number of spaces allowed to move are weighted to the difficulty of the question.

The game is designed to be played by two to six players, each representing an individual who wishes to build a small brewery. The object of the game is to be the first player to successfully collect all six brewery equipment pieces (40) to (45), thereby being the first to build a brewery or until at least one player decides the game is over.

To begin play, each player uses the chance indicator means; preferably by rolling a die (29) to determine the order of play. In the event of a tie, the die (29) is rolled a second time as a tie-breaker. Each player starts with a game piece chosen from those shown in FIG. 3. Each player begins at the start space (13) and moves around the game board in a clockwise direction, according to a roll of the die (29). The player must then follow the directions of the space landed on, either answering a question, or drawing a card. If a player lands on a hop (14), barley (15), yeast (16), or brewing science (17) space, they must correctly answer a question related to that subject. A player other than the one currently rolling, should be chosen to draw question cards and ask the question of the current player. If the question is answered correctly, the player may roll again and proceed to the next spot, and may continue until a question is not answered correctly. If the question is answered incorrectly or, cannot be answered at all, the player must remain on that space until their next turn, when they will again be required to answer a question related to that space. If they answer correctly, they may then roll and proceed to the next space. If they still are unable to answer correctly, they must remain and wait until their next turn. The player may move on the third pass, without answering a question by simply rolling the die (29).

If a player lands on a mystery pint space (18), they must draw a mystery pint card (24). Mystery pint cards(24) can award or take away brewery equipment pieces, send the player to prohibition land, (46) advance the player on the game board(10), grant a ticket out of prohibition land (46), or cause a player to have to skip a turn. The player must wait until 2 turns have passed or use a ticket out of prohibition land. The player then resumes play from the original mystery pint space landed on. The player must take whatever action the card calls out such as; "fermenter exploded-a total loss." In this example the player would be required to give up their fermenter (44) equipment piece if they had one.

If a player lands on a specialty space (19), then that player must answer a specialty card (25) question. Specialty cards (25) allow a player to move ahead a certain number of spaces on the board if the question is answered correctly and then they wait until their next turn. There is no penalty for an incorrect answer. The player just waits until their next turn and rolls the die (29) again to advance.

When a player lands on a corner space (26), the player is not required to take any action. These spaces are safe zones where a player remains until the player's next turn.

A player is awarded a brewery equipment piece each time they complete a full circuit on the game board (10). Brewery equipment pieces are awarded in order of a mill (40), mash/lauter tun (41), kettle (42), exchanger (43), fermentation tank (44) and a conditioning/serving tank (45) or as needed. Surplus brewery equipment pieces can be held as insurance against mystery pint cards (24) that take away brewery equipment pieces. The game is won when the first player collects at least one of the mill, mash/lauter tun, kettle, exchanger, fermentation tank and a conditioning/serving tank pieces.

I claim:

1. A method of playing a board game based on the brewing of beer including: a game board having an endless track thereon, said endless track formed by a continuous series of spaces over which a player advances during play of the game in which at least two players take turns as described below, at least one of said spaces being a starting space and said spaces other than said starting space having indicia thereon corresponding to a respective area of brewing; a plurality of differently identified playing pieces, each assigned to a different player; a first set of cards having indicia thereon corresponding to said spaces, the cards containing information in the form of questions and answers relating to beer and brewing; a second set of cards containing penalties or rewards of chance; a chance indicator means for determining advancement of said playing pieces around the board from space to space; and a plurality of tokens representing the equipment required for building a brewery, said method comprising the steps of at least two players in turn:

a. advancing a playing piece along a predetermined number of said spaces, as determined by said chance indicator means;

b. identifying the set of cards corresponding to the space upon which said playing piece lands;

c. picking a card from the stack corresponding to said set of cards;

d. asking the question from said card or following the directions on the card;

e. permitting the player to correctly answer the question if required by the card and allowing said player to repeat steps (a)–(e);

f. repeating steps (a)–(e) for another player if the first mentioned player incorrectly answers the question or loses a turn as a result of the directions on the card;

g. supplying a marker corresponding to a piece of equipment needed for building a brewery when the playing piece passes or lands on the starting space; and h. terminating play when at least one player receives a marker for each piece of equipment required to build a brewery or at least one player decides the game is over.

* * * * *